United States Patent [19]

Hashimoto et al.

[11] 4,035,159

[45] July 12, 1977

[54] IRON-BASE SINTERED ALLOY FOR VALVE SEAT

[75] Inventors: Kametaro Hashimoto; Kenji Ushitani; Youichi Serino; Tetsuya Suganuma, all of Toyota; Seishu Mitani, Kyoto; Kunizou Imanishi, Nagoya, all of Japan

[73] Assignee: Toyota Jidosha Kogyo Kabushiki Kaisha, Toyota, Japan

[21] Appl. No.: 663,519

[22] Filed: Mar. 3, 1976

[51] Int. Cl.[2] ..... B22F 3/00

[52] U.S. Cl. ..... 75/246; 428/546; 75/200; 75/201; 75/126 R; 75/126 C; 75/126 L; 75/126 Q; 75/128 R; 75/128 W; 75/128 C; 75/128 P

[58] Field of Search ..... 75/201, 214, 200, 126 R, 75/126 C, 126 L, 126 Q, 128 R, 128 W, 128 C, 128 P; 29/182.5, 182

[56] References Cited

U.S. PATENT DOCUMENTS

| | | | |
|---|---|---|---|
| 2,844,500 | 7/1958 | Peras | 75/126 Q |
| 3,847,600 | 11/1974 | Mimino et al. | 75/126 C |
| 3,856,478 | 12/1974 | Iwata et al. | 29/182 |
| 3,925,065 | 12/1975 | Osawo et al. | 75/126 C |

OTHER PUBLICATIONS

Chemical Abstracts vol. 80 No. 18165 (1974).

*Primary Examiner*—Brooks H. Hunt
*Attorney, Agent, or Firm*—Brisebois & Kruger

[57] ABSTRACT

Iron-base sintered alloy for the valve seats of internal combustion engines is an iron-base alloy powder containing, by weight, 6 – 20% chromium less than 2.0% nickel, and carbon 0.2 – 1.5%, together with at least one additive selected from among 0.3 – 1.5% manganese, 0.2 – 1.5% sulfur, 0.5 – 8% molybdenum, and 0.5 – 2.5% silicon, and molded to a sintered density of 6.2 – 6.8 g/cm$^3$.

9 Claims, 3 Drawing Figures

IRON-BASE SINTERED ALLOY FOR VALVE SEAT

BACKGROUND OF THE INVENTION

The conventional materials used for making valve seats include cast iron, cast steel, heat-resistance steel, non-ferrous alloys and sintered alloys. A wide variety of sintered alloys with different characteristics have been developed. Use of these conventional sintered alloys, however, yields unsatisfactory results in most cases with lead-free gasoline, though good results are obtained when the gasoline contains an adequate amount of such anti-knock additives as tetraethyl lead.

Various organic leads added to the gasoline as anti-knocking agents turn into lead oxides when the gasoline burns and, when deposited on the valve and valve seat surface, they serve to protect and lubricate the valve seat or absorb the energy of valve impact, thereby preventing wear of the valve seat, but when lead-free gasoline is used, the wear-preventing effect of lead is absent and accordingly the valve seat suffers heavy wear. During use of a high-octane gasoline with much tetraethyl lead, great quantities of the products of combustion are deposited on the valve seat surface and are likely to cause heavy oxidation and lead corrosion on the valve seat of conventional materials. At the same time, as the result of a temperature rise in the exhaust system of an internal combustion engine provided with anti-emission equipment for the prevention of air pollution, the heat load of the exhaust gas on the valve seat increases and conventional materials which lack heat-and-wear resistance cannot stand up under severe operating conditions of the engine. Thus the valve seat materials have come to be required to possess higher resistances to wear, oxidation and lead corrosion and be able to stand up under severe operating conditions.

Furthermore, a valve seat, which has been pressed into a cast iron cylinder head in a conventional manner, is liable to drop out when subjected to a heavy heat load. Thus the valve seat material is required to have a lower coefficient of thermal expansion.

BRIEF SUMMARY OF THE INVENTION

The object of the present invention is to provide an improved iron-base sintered alloy for the seats of internal combustion engines which is characterized by excellent resistances to oxidation, lead corrosion and wear as well as a low coefficient of thermal expansion, and can perform satisfactorily when using either conventional leaded gasoline or leadfree gasoline, even when the temperature in the exhaust system is high.

Another object of the present invention is to provide an iron-base sintered alloy for valve seats which has its coefficient of thermal expansion lowered sufficiently to eliminate any risk of the valve seat dropping out, and which is accordingly available for a wide range of applications.

DETAILED DESCRIPTION OF THE INVENTION

Figure 1:
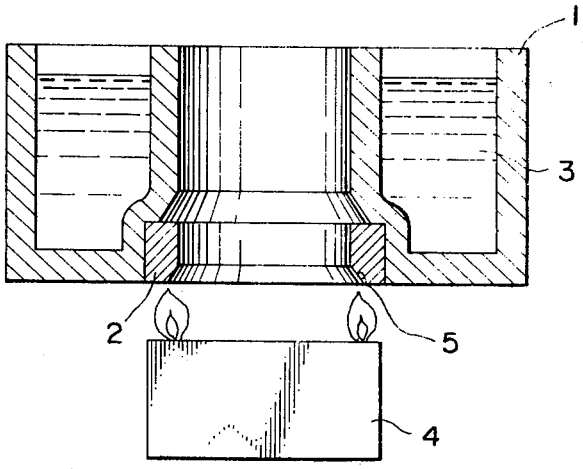
FIG. 1 is a sectional view of an apparatus for testing the dropout durability of a valve seat.

The effects of different constituents contained in the iron-base sintered alloy of the present invention and the reasons for limiting their contents will now be explained.

The feature of the iron-base sintered alloy according to the present invention lies in the use of an iron-chromium-nickel alloy powder as the base. The chromium content of this base forms a carbide which contributes to improvement of the wear resistance as well as to the enhancement of the resistance to oxidation and to lead corrosion. When the chromium content is less than 6% by weight, it has little effect, but the addition of more than 20% is not so effective as might be expected, since it lowers the strength of the alloy. For this reason, the chromium content is limited to the range of 6 – 20%.

Nickel is useful for increasing the resistances to oxidation and to lead corrosion. In an iron-chromium-nickel system alloy an increased addition of nickel will enlarge the austenite region in the matrix, thereby increasing the coefficient of thermal expansion. For instance, when nickel is 2 – 20%, it would be difficult to hold the coefficient of thermal expansion down to less than $13.5 \times 10^{-6}$ in the range of 0° – 600° C. Accordingly the utility of the valve seat will be restricted when such an alloy is employed. At the same time, a nickel content of less than 2.0% will make it easy to increase the hardness and strength of the alloy. Thus the nickel content is limited to less than 2.0%.

Carbon forms a solid solution or a chromium carbide in the matrix, thereby increasing the hardness and strength as well as the wear resistance of the alloy. It will not be effective when the addition is less than 0.2%, but the addition of more than 1.5% is likely to develop a liquid phase in sintering and lower the resistance to oxidation. Thus the carbon content is limited to the range of 0.2 – 1.5%.

Manganese and silicon which form a solid solution in the matrix are effective elements for enhancing the resistance to oxidation and increasing the strength of the alloy. There will be no effect when manganese is less than 0.3% or silicon is less than 0.5%, but the alloy will be embrittled if the manganese is more than 1.5% or the silicon is more than 2.5%. Thus the manganese content and the silicon content are limited respectively to 0.3 – 1.5% and 0.5 – 2.5%. Manganese and silicon may be added singly or in the form of an alloy powder such as ferromanganese or ferrosilicon.

Sulfur, when added, reacts with the alloying elements in sintering to form a sulfide, whose lubricating effect improves the wear resistance of the alloy. However, the addition of less than 0.2% is not effective, while the addition of more than 1.5% decreases the strength and resistances to oxidation and to lead corrosion of the alloy and results in a poor yield. Thus the sulfur content is limited to 0.2 – 1.5%. Sulfur may be added singly, but it can also be added in the form of a sulfide such as $MoS_2$, ZnS, FeS or $Cu_2S$.

Molybdenum is an element which enhances the strength of the alloy at high temperatures. Its effect, however, will not appear at less than 0.5%, while at more than 8% the wear resistance may be improved but no improvement will take place in the resistances to oxidation and lead corrosion. Thus the molybdenum content is limited to 0.5 – 8%. Molybdenum may be added singly or in the form of alloy powder such as ferromolybdenum.

At a sintered density of less than 6.2 g/cm$^3$, the strength of the alloy tends to be insufficient, while the resistance to oxidation, lead corrosion and wear are likely to drop. If, however, the density is greater than 6.8 g/cm$^3$, not only will the wear resistance fail to improve, but molding will become difficult and the molded article is likely to crack and chip, resulting in a shortened life for the molded article. Thus the sintered density is limited to 6.2 - 6.8 g/cm$^3$.

At a sintering temperature of less than 1120° C the sintering is insufficient, resulting in an insufficient strength of the alloy, while at a sintering temperature of more than 1200° C a liquid phase is liable to develop, resulting in instability of product quality. Thus it is desirable to sinter at 1120° - 1200° C, one time.

The following examples specifically illustrate the present invention.

EXAMPLE 1.

The mass of −100 mesh base alloy powder composed of chromium 15%, nickel 1% by weight and the balance iron, to which the following have been added: flaky graphite —0.5%, −250 mesh silicon — 1.5% (hereafter silicon of the same particle size is used) and molybdenum of 3$\mu$ average size −1% (hereafter molybdenum of the same particle size is used), together with 0.5% zinc stearate as a lubricating agent, was blended for 30 minutes in a V-type mixer.

Next, the same mass was pressure-molded to a density of 6.5 g/cm$^3$ in a mechanical press and sintered for 40 minutes at 1150° C in a dry hydrogen atmosphere. Thus an iron-base sintered alloy according to the present invention having the final composition Fe—15-Cr—1Ni—1.5Si—1Mo—0.4C was produced.

EXAMPLE 2.

0.5% graphite, 0.5% silicon, and 1.5% of −250 mesh manganese (hereafter manganese of the same particle size is used), were added to the iron-chromium-nickel alloy powder of Example 1. Thereafter, in the same way as in Example 1, an iron-base sintered alloy according to the present invention having the final composition Fe—15Cr—1Ni—0.5Si—1.5Mn—0.4C was produced.

EXAMPLE 3.

0.5% graphite, 2.5% silicon and 0.3% manganese were added to the iron-chrome-nickel system alloy powder of Example 1. Then an iron-base sintered alloy according to the present invention with the final composition Fe—15Cr—1Ni—2.5Si—0.3Mn—0.4C was produced in the same way as in Example 1.

EXAMPLE 4.

0.2% graphite, 8% molybdenum and 1% manganese by weight were added to −100 mesh base alloy powder composed of 6% chromium, 2% nickel and the balance iron. Then an iron-base sintered alloy according to the present invention with the final composition Fe—6-Cr—2Ni—8Mo—1Mn—0.2 C was produced in the same way as in Example 1.

EXAMPLE 5.

1.5% graphite, 0.5% molybdenum, and 2% sulfur by weight, with the sulfur having an average particle size of 5$\mu$ (hereinafter, sulfur of the same particle size in used), were added to −100 mesh base alloy powder composed of 20% chromium, 0.2% nickel and the balance iron. Then an iron-base sintered alloy according to the present invention with the final composition Fe—19Cr—0.2Ni—0.5Mo—0.1S—1.3C was produced in the same way as in Example 1.

EXAMPLE 6.

1.5% graphite, 4.5% molybdenum, and 1.5% sulfur were added to the iron-chrome-nickel base alloy powder of Example 5. Then an iron-base sintered alloy according to the present invention with the final composition Fe—19Cr—0.2Ni—4.5Mo—1.3S—1.3C was produced in the same way as in Example 1.

To verify the effect of using the iron-chrome-nickel system base alloy powder according to the present invention, an alloy of the same composition as the invented alloy was produced by adding respective elements without using the above-mentioned base alloy powder (see Comparison 1), while a heat-resistant steel of about the same composition as that in Example 1 was produced (see Comparison 2).

Meanwhile, another alloy with only its nickel content out of the limited range of element contents in the invented iron-base sintered alloy was produced (see Comparison 3).

Comparison 1.

24% of a ferrochrome alloy powder (Fe—63Cr) of −200 mesh, 1% of a carbonyl nickel powder of average particle size 5$\mu$, 1.5% silicon, 1% molybdenum, and 0.5% graphite were added to a balance of iron powder and blended together and, following the same process as in Example 1, a sintered alloy of the same composition as in Example 1 was obtained.

Comparison 2.

Steel of about the same composition as in Example 1 was produced.

Comparison 3.

0.5% graphite, 1.5% silicon, and 1% molybdenum were added to −100 mesh base alloy powder composed of 15% chrome and 8% nickel, by weight, with the balance iron. Thereafter, following the same process as in Example 1, a sintered alloy comprising Fe—15-Cr—8Ni—1.5Si—1Mo—0.4C, the same composition as in Example 1, except for an increased nickel content, was obtained.

The sintered alloys obtained in these examples and comparisons were subjected to various tests.

Hardness was measured in terms of Vickers hardness, Hv(10), at ambient temperature. Strength was measured in terms of the maximum rupture strength of a pressure ring at ambient temperature in a ring test. For oxidation, the test specimen was heated at 800° C for 100 hours in the atmosphere, and the weight of the layer of scale on the specimen surface is indicated in terms of its ratio to the original weight of the specimen, as a measure of anti-oxidation property. This ratio was calculated according to the following formula:

$$\text{Ratio of scale weight} = \frac{\text{Scale weight}}{\text{Original weight}} \times 100\ (\%)$$

In the lead corrosion test, the specimen was buried in lead monoxide powder and heated at 800° C for 1 hour, whereby the specimen lost weight due to corrosion through contact with lead monoxide in the solid state and the weight loss was indicated as a corrosion loss per unit surface area of the specimen before testing. The following formula was used:

$$\text{Lead corrosion loss} = \frac{\text{Corrosion loss}}{\text{Original surface area}} \ (\text{g/dm}^2\text{/hr})$$

Wear resistance was estimated in terms of the width of a worn mark in the Ogoshi type wear test.

The coefficient of thermal expansion was measured using a Leitz thermal expansion measuring device in vacuum in the temperature range of 0° – 600° C.

The results of tests are summarized in Table 1.

Table 1

| Specimens | Test items | Hardness (at ambient temp.) Hr(10) | Pressure ring strength (at ambient temp. Kg/mm² | Oxidation at 800° C ×100Hr (oxide scale ratio) % | PbO corrosion 800° C (corrosion loss) g/dm²/Hr | Wear (Ogoshi) mm | Coeff. of therm. expan. (0–600° C) × $10^{-6}$ |
|---|---|---|---|---|---|---|---|
| Examples | 1 | 283 | 86 | 2.0 | 2.5 | 0.8 | 12.8 |
| | 2 | 200 | 78 | 2.2 | 2.7 | 1.0 | 12.2 |
| | 3 | 302 | 82 | 1.7 | 2.4 | 0.7 | 13.1 |
| | 4 | 320 | 73 | 3.5 | 4.0 | 0.9 | 13.5 |
| | 5 | 244 | 77 | 1.8 | 1.9 | 1.3 | 11.7 |
| | 6 | 265 | 76 | 2.0 | 2.3 | 1.0 | 12.0 |
| Comparisons | 1 | 230 | 55 | 6.7 | 10.0 | 3.5 | 13.0 |
| | 2 | 326 | 150 | 2.1 | 5.5 | 7.0 | 13.5 |
| | 3 | 172 | 68 | 1.6 | 2.2 | 1.7 | 16.8 |

As seen from Table 1, the iron-base sintered alloys according to the invention are nearly equivalent in resistances to oxidation and lead corrosion to the heat-resistant steel of comparison 2. The alloy in comparison 1 to which specified elements have been arbitrarily added proved unsatisfactory. This can be explained as follows: Whereas in the present invention an iron-chrome-nickel system alloy powder is taken as the base and the main elements are distributed in the matrix with relative uniformity, in Comparison 1 a macroscopic variance in density develops due to incomplete diffusion of the alloying elements during sintering.

In the iron-base sintered alloy according to the present invention, as seen from Table 1 the pressure ring strength and the wear resistance are improved through appropriate selection of the base alloy composition.

The coefficient of thermal expansion can be improved, depending on the nickel content, as seen from Comparison 3 and Example 1, the values being 16.8 × $10^{-6}$ and 12.8 × $10^{-6}$ respectively. Thus the reason for limiting the nickel content is clear.

For this reason, the permissible limit of the coefficient of thermal expansion for the valve seat material has been determined and the nickel content limited so that this coefficient will fall below that limit.

Referring to FIG. 1 illustrating a section of the apparatus to be used for the dropout test of valve seat, the test process will now be described.

Figure 2:
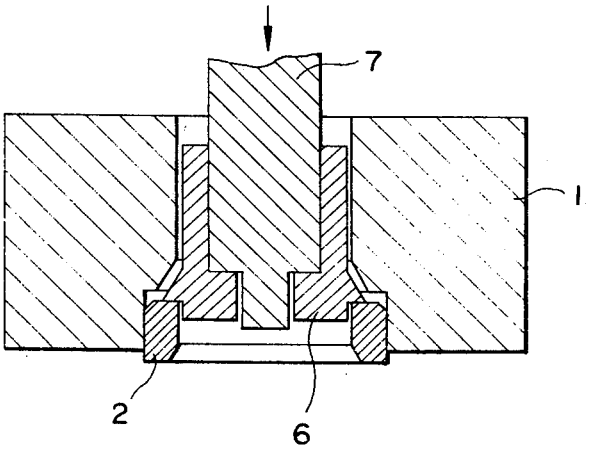
FIG. 2 is a sectional view of a pulling force measuring device.

A test specimen 2 in the shape of a valve seat ring is pressed into a cast iron or aluminum holder 1. The cooling water 3 filling the holder 1 is kept at 100° C. At the same time the seat side of the test specimen 2 is heated by propane gas burner 4. The surface temperature is maintained at 600° C for 100 hours, using a thermocouple 5. The test specimen 2 after the dropout test is pulled out of the holder 1 and the force required to do so measured, using a device having the section illustrated in FIG. 2.

With the split jig 6 for pull-load measurement applied to the seat side of the test specimen 2, the jig 7 is fitted and pressed by the Instron type testing machine. The force required to pull out the test specimen 2 is thereby measured and the seat pulling force decline rate is estimated using the following formula:

Seat pulling force decline rate (%) = $B-A/B \times 100$ where $A$ . . . pulling force after dropout test (kg)

$B$ . . . pulling force before dropout test (kg) (fresh seat)

Figure 3:
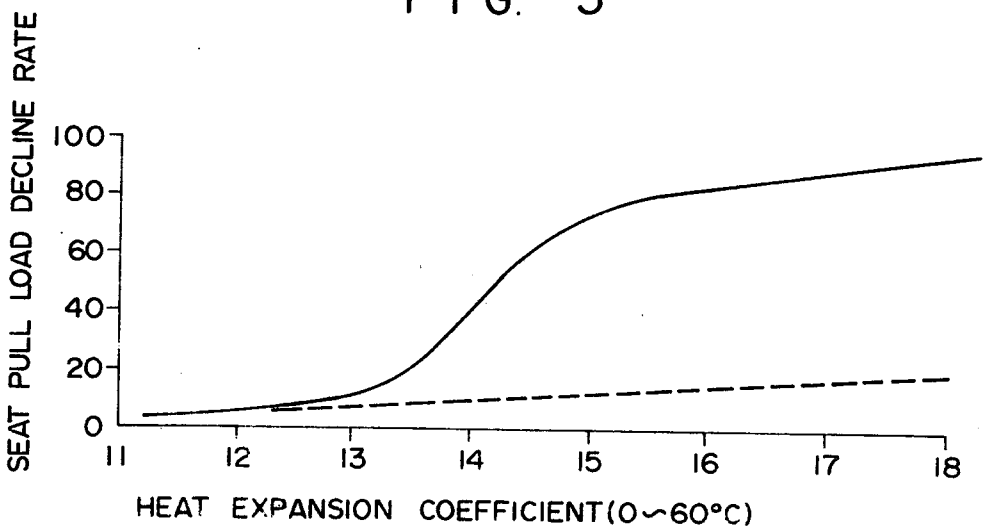
FIG. 3 is a diagram showing the relation between the force required to separate the seat from the valve and the coefficient of thermal expansion when the seat is made of various iron-base sintered alloys.

The pulling force decline rates of different seats including seats made of the iron-base sintered alloys according to the invention have been measured using an aluminum holder and a cast iron holder, the results being summarized in FIG. 3.

As indicated in FIG. 3, when an aluminum holder (coefficient of thermal expansion: 21 × $10^{-6}$) is employed, the pulling force decline rate is so low even at a coefficient of thermal expansion equal to 18 × $10^{-6}$ that there is no hazard of the seat dropping out. When a cast iron holder is used the pulling force decline rate is high at the seat's coefficient of thermal expansion, which is over 13.5 × $10^{-6}$, and there is a substantial risk that the valve seat will drop out of the cast iron cylinder head. A seat insert for a cast iron cylinder head is therefore required to have a coefficient of thermal expansion less than 13.5 × $10^{-6}$. For this reason the nickel content in the present invention is limited to less than 2% to hold the coefficient of thermal expansion down to less than 13.5 × $10^{-6}$.

What is claimed is:

1. Method of manufacturing an iron-base sintered alloy for use in valve seats which comprises the steps of adding 0.2 – 15% carbon in the form of graphite powder, and at least two additives selected from the group consisting of 0.3 – 1.5% manganese, 0.2 – 1.5% sulfur, 0.5 – 8% molybdenum, and 0.2 – 2.5% silicon by weight to a constituent alloy in powder form having an iron base and containing 6 – 20% chromium and 0 – 2.0% nickel by weight, molding the resulting mixture to a required shape by applying pressure thereto, and then sintering the molding at a temperature of 1120° – 1200° C to yield an alloy having a sintered density of 6.2 – 6.8 g/cm³.

2. Method as claimed in claim 1, in which sulfur is added in the form of sulfide.

3. Method as claimed in claim 1, in which manganese, silicon and molybdenum added are in the form of iron compounds.

4. Method as claimed in claim 1 in which said alloy in powder form comprises 1 – 2% nickel.

5. Iron-base sintered alloy made by the process of claim 1.

6. Iron-base sintered alloy made by the process of claim 1 in which said constituent alloy comprises 1 – 2% nickel.

7. Iron-base sintered alloy made by the process of claim 6 comprising 0.3 – 1.5% manganese, 1 – 8% molybdenum and 1.5 – 2.5% silicon.

8. Iron-base sintered alloy made by the process of claim 6 comprising 0.2 – 1.5% sulfur and 1.5 – 4.5% molybdenum.

9. Iron-base sintered alloy made by the process of claim 6 in which said constituent alloy powder has a particle size of −100 mesh.

* * * * *